United States Patent [19]

Williams

[11] Patent Number: 4,865,192

[45] Date of Patent: Sep. 12, 1989

[54] GOLF BAG SUPPORT SYSTEM

[75] Inventor: Thomas W. Williams, Columbia, S.C.

[73] Assignee: Sports Specialties, Inc., Columbia, S.C.

[21] Appl. No.: 192,227

[22] Filed: May 10, 1988

[51] Int. Cl.[4] ..... A63B 55/04

[52] U.S. Cl. ..... 206/315.7; 206/315.6; 206/315.8; 248/96

[58] Field of Search ..... 206/315.2, 315.3, 315.4, 206/315.5, 315.6, 315.7, 315.8; 248/96, 156

[56] References Cited

U.S. PATENT DOCUMENTS

| | | | |
|---|---|---|---|
| 1,227,657 | 5/1917 | Pierce . | |
| 1,452,084 | 4/1923 | Luckett | 206/315.7 |
| 1,488,389 | 3/1924 | Hibbert | 206/315.7 |
| 1,502,300 | 7/1924 | Fairchild | 206/315.7 |
| 1,715,668 | 6/1929 | Mooney | 206/315.7 |
| 1,741,057 | 12/1929 | Howe . | |
| 1,826,216 | 10/1931 | Johnson . | |
| 1,926,184 | 9/1933 | Schwer . | |
| 1,956,008 | 4/1934 | Deibel . | |
| 2,045,147 | 6/1936 | Johnson . | |
| 2,091,298 | 8/1937 | Agnew . | |
| 2,453,565 | 11/1948 | Barden | 248/156 X |
| 2,600,713 | 6/1952 | Wells | 248/96 |
| 2,633,317 | 3/1953 | Marsh | 248/96 |
| 3,435,886 | 4/1969 | Cantwell . | |
| 3,570,795 | 3/1971 | Benzel | 248/96 |
| 4,071,062 | 1/1978 | Ianetta | 206/315.7 |
| 4,152,003 | 5/1979 | Reineccius et al. | 248/96 X |
| 4,635,793 | 1/1987 | Kim | 206/315.6 |
| 4,645,152 | 2/1987 | Downing | 248/96 |
| 4,691,884 | 9/1987 | Parduhn | 248/96 |

FOREIGN PATENT DOCUMENTS

| | | | |
|---|---|---|---|
| 3584 | of 1892 | United Kingdom | 206/315.6 |
| 17918 | of 1892 | United Kingdom | 206/315.6 |
| 14887 | of 1913 | United Kingdom | 206/315.6 |
| 9020 | of 1915 | United Kingdom | 206/315.6 |
| 182698 | 7/1922 | United Kingdom | 206/315.6 |
| 340352 | 1/1931 | United Kingdom | 206/315.6 |
| 473388 | 10/1937 | United Kingdom | 206/315.7 |

*Primary Examiner*—Sue A. Weaver

*Attorney, Agent, or Firm*—Michael A. Mann

[57] ABSTRACT

An improvement for a golf bag is disclosed wherein the improvement comprises an adjustable internal supporting apparatus having a retractable spike for standing a golf bag upright on the ground which apparatus also provides general longitudinal support of the golf bag. The apparatus has a central shaft between a club separator attached to the top collar of a golf bag having flexible sides and the bottom collar at the base of the bag. A hollow tube sliding within the shaft bears a solid spike threaded to its lower end for sticking in the ground and a handle threaded to its upper end. The upper end of the shaft is guided by a hole in the club separator; the lower end is guided by a hole in a cup attached to the bottom collar of the golf bag. A spring, one end of which is clipped to the upper end of the inside of the shaft, the other end inserted into a hole in the side of the hollow tube, is stretched by downward pressure from the hand on the tube handle. The spring has just enough tension to retract the spike into the cup when the golf bag is lifted free of the ground. The tension of the flexible sides between the top collar and the bottom collar is adjusted by tightening a tension modulator threadably received by a cup forming the base of the golf bag.

6 Claims, 3 Drawing Sheets

GOLF BAG SUPPORT SYSTEM

BACKGROUND OF THE INVENTION

The present invention relates to improvements in golf bags. More specifically, it relates to mechanisms for supporting golf bags in an upright position using a ground spike.

The typical golf bag is generally a long cylinder with a collar at the top and a collar at the bottom. The lower collar includes a base that seals the bottom, except for a plurality of drain holes. A flexible material forms the sides and may contain one or more compartments for storage. A golf bag is usually large enough and sturdy enough to contain a full compliment of fourteen clubs plus golfing gear such as golf balls, golf tees, a golf shoe cleat wrench, perhaps also an umbrella and a jacket.

The weight of a golf bag with golf equipment can be significant. Given the length of golf courses and the weight of a golf bag, many golfers choose to use golf carts or golf carriers. Many other golfers, however, prefer to exercise by walking the course and carrying a golf bag.

However, when a golfer prepares to hit a golf ball, the carried golf bag is placed on the ground. When the ball has been hit, the bag is picked up. For a typical golfer, the stooping and lifting takes place approximately one hundred times in an 18 hole round of golf. Furthermore, the ground can frequently be muddy or wet with dew. The carried bag can become wet or muddied from being laid on the ground and will transfer moisture and mud to the clothes of the golfer carrying the bag.

To eliminate the problems associated with laying a golf bag down while the golfer prepares to hit a golf ball, many attempts have been made to develop a golf bag that will stand upright when unattended. The typical approach is to fit the bag with a retractable spike. Sometimes these spiking mechanisms are backfitted to the exterior of an existing bag and sometimes they are mounted to the interior of a bag. Springs have been included in such apparatuses to retract the spike. Examples of previous attempts at golf bag support systems include U.S. Pat. No. 1,741,057 issued to Howe, U.S. Pat. Nos. 1,826,216 and 2,045,147 issued to H. T. Johnson, Schwer's U.S. Pat. No. 1,926,184, Agnew's spiked carrier disclosed in U.S. Pat. No. 2,091,298, Marsh's foot operated spike in U.S. Pat. No. 2,633,317, springless spikes in Cantwell's U.S. Pat. No. 3,435,866 and Benzel's U.S. Pat. No. 3,570,795, exterior spikes in Downing's U.S. Pat. No. 4,645,152 and Perduhn's U.S. Pat. No. 4,691,884.

Many of the above referenced inventions are attached to the outside of a standard bag where they can work loose, they can scratch and tear the exterior of a golf bag and some do not harmonize with the appearance of a modern, full size standard golf bag.

Many are expensive to fabricate and have insufficient support to maintain the alignment of the spike with the bag.

It is important in the sport of golf to recognize the environment where the sport takes place. A golfer does not want to have soiled clothes or to carry a golf bag having a heavy, clumsy, conspicuous device of any kind. Furthermore, a golf bag support apparatus must be light-weight, easy-to-use, reliable and a natural part of the golf bag. Furthermore, given the cost of playing golf and the financial investment in golfing equipment, the incremental cost of the support apparatus must be minimal.

It is an object of the present invention to provide a light weight apparatus for supporting an unattended golf bag in the upright position. It is an object of the present invention to provide longitudinal support for a golf bag generally by a central, internal means thus eliminating the need for peripheral, longitudinal support. It is an object of the present invention for the apparatus to be reliable, sturdy, easy to use and inexpensive to manufacture.

It is a further object of the present invention to allow the golf bag to be adjustable so that changes in the tension of the flexible sides of the bag, due to such causes as temperature changes, can be accommodated easily.

It is yet a further object of the invention to provide for the full retraction of the spike upon lifting the bag clear of the ground.

It is a still further object of the invention to permit the removal of the spike so that the golf bag may fit in a standard golf bag shipping carton and so that the spike may be easily replaced if worn or bent.

It is a further object of the invention to provide an inconspicuous mechanism for golf bag support.

These and other objects of the invention will become obvious to a person skilled in the art of golf bag support apparatus and from a fair reading of the following description of the present invention and the claims.

SUMMARY OF THE INVENTION

It has been found that the above objectives can be achieved according to the present invention by providing a golf bag having a top collar, a club separator attached to the top collar, a bottom collar and cup attached to the bottom collar. A flexible material attached to the top and bottom collars forms the sides of the golf bag. The club separator and cup are held in spaced relation with respect to each other by a central shaft.

A tube having a handle at its top and a spike threaded to its bottom, slides within the central shaft. Pushing downward on the handle slides the tube from an at-rest position in which the handle at the top of the shaft extends above the club separator, to an actuated position in which the spike extends below the cup a sufficient distance to allow the spike when stuck in the ground to hold the golf bag upright. The spike retracts from the actuated positon to the at rest position by means of a spring within the shaft, one end attached to the tube and the other attached to the shaft, when the bag is lifted free of the ground. A tension modulator within the cup allows the distance between the top collar and the bottom collar of the golf bag to be adjusted to change the tension in the sides of the bag and maintain the alignment of the shaft and spiking apparatus. Movement of the tension modulator is achieved preferably by the golf shoe cleat wrench; alternatively, or in addition to the use of a golf shoe cleat wrench, the tension modulator can have a slot to receive a screw driver or coin so that the tension can be adjusted without any special tools.

DETAILED DESCRIPTION OF THE PREFERRED EMBODIMENT

The present invention is an improvement in a standard, full sized golf bag. The improvement is a longitudinal support system for holding the top and the bottom of the bag in spaced relation so that there is suitable tension in the flexible material of the sides of the bag, and a light-weight, reliable, easily manufactured, retractable spiking mechanism incorporated inconspicuously into the overall support system so that the weight of the golf bag is kept to a minimum and the spiking mechanism does not interfere with the primary purpose of the bag, namely, to serve as a container for golf clubs.

Figure 1:
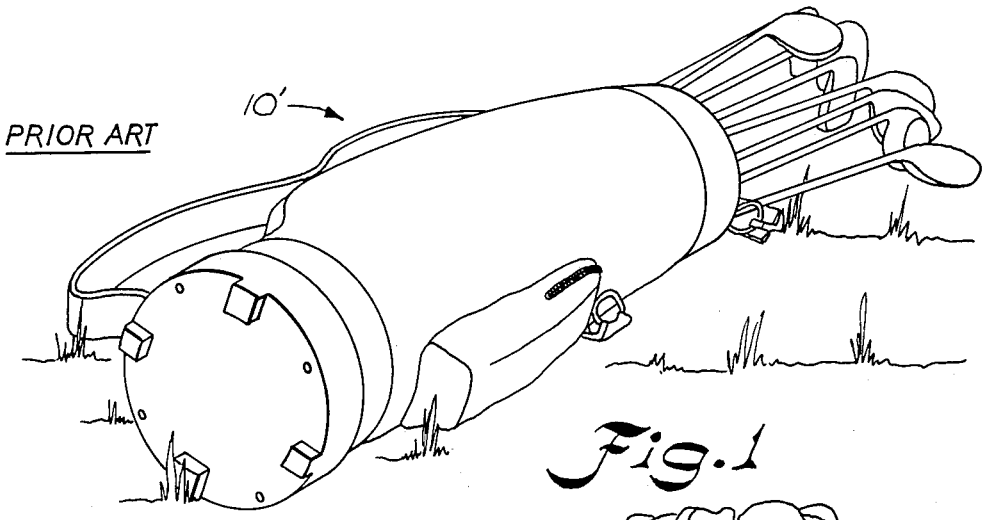
FIG. 1 shows the prior art in use.

FIG. 1 shows the prior art standard bag 10' as it is currently used when a golfer is preparing for a shot. The golf bag is laying on the ground with the sides of the bag and the clubs coming in contact with the grass and perhaps mud and dew.

Figure 2:
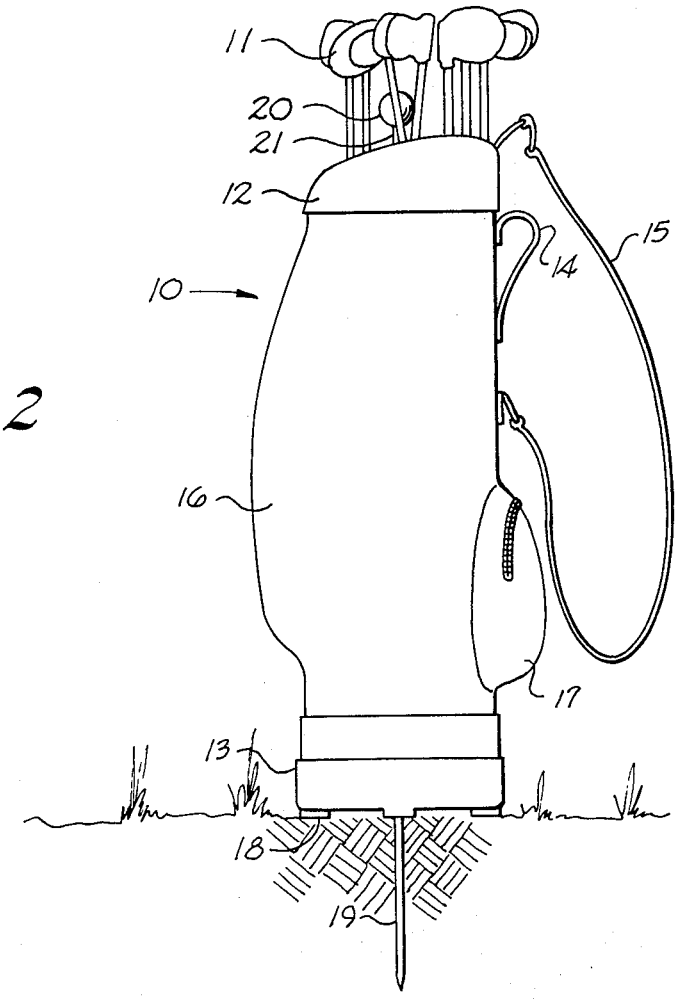
FIG. 2 shows a side view of a standard golf bag with the apparatus.

In FIG. 2 a profile of the standard golf bag 10 with the improvement of the present invention. The golf bag 10 is shown having clubs 11 projecting just above a rigid top collar 12. Only the bottom collar 13 of the golf bag 10 rests on the ground. The handle 14 and carrying strap 15 allow the bag to be lifted and carried on the shoulder, respectively.

The handle 14 is attached to the flexible material of the sides 16 of the bag 10 which also has a compartment 17 for golfing paraphernalia such as golf balls, tees, a golf shoe cleat wrench, and the like. The bottom collar is slightly elevated by pods 18 and held in place on the ground by spike 19.

Figure 3:
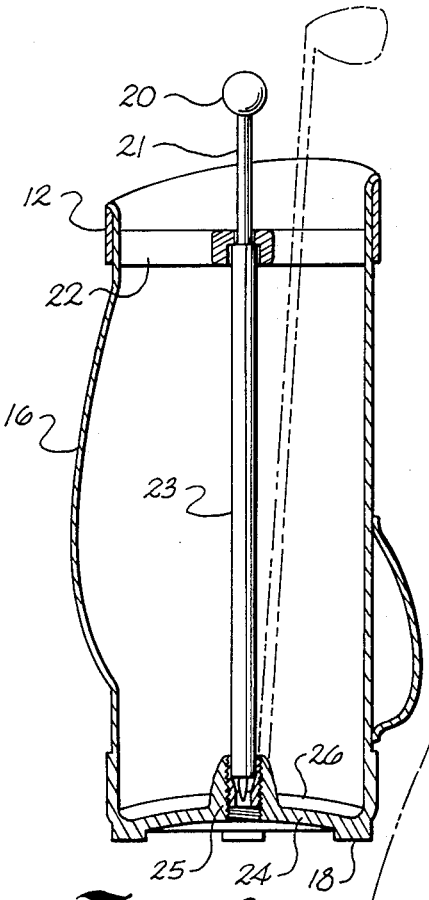
FIG. 3 shows a cross-sectional view of a golf bag with the apparatus.

Best seen in FIG. 3 in a cross sectional view of the golf bag 10, with sides 16 attached to top collar 12 and bottom collar 13 and pods 19, is the handle 20 threadably attached to the tube 21. Tube 21 slides through a hole in the club separator 22. The top of the shaft 23 abuts the bottom of the club separator 22.

Figure 4:
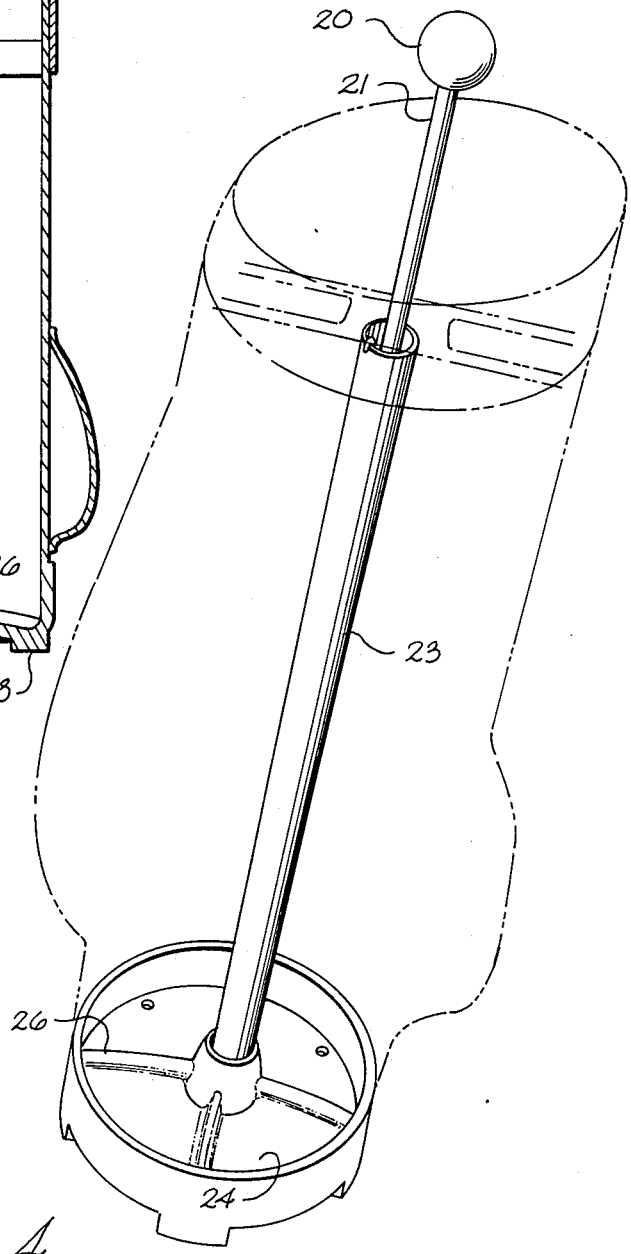
FIG. 4 shows a perspective view from the top of the apparatus showing especially the shaft, the cup and the tension modulator.

At the bottom of the bag 10 is the cup 24. The cup 24 is a circular flange having a threaded hole for receiving the tension modulator 25. Shaft 23 rests on the tension modulator. The cup 24 is preferably concave upwards and provided with a plurality of radial arms 26, best seen in FIG. 4. The concavity of the cup 24 resists increasing downward pressure exerted by the shaft 23 as the tension modulator 25 is tightened. The radial arms 26 provide additional stiffening. Increasing the strength of the cup 24 with radial arms 26 and concavity helps to reduce amount of material needed to provide a firm base for the golf bag 10 and thereby minimizes the weight of the bag 10 generally.

Figure 5:
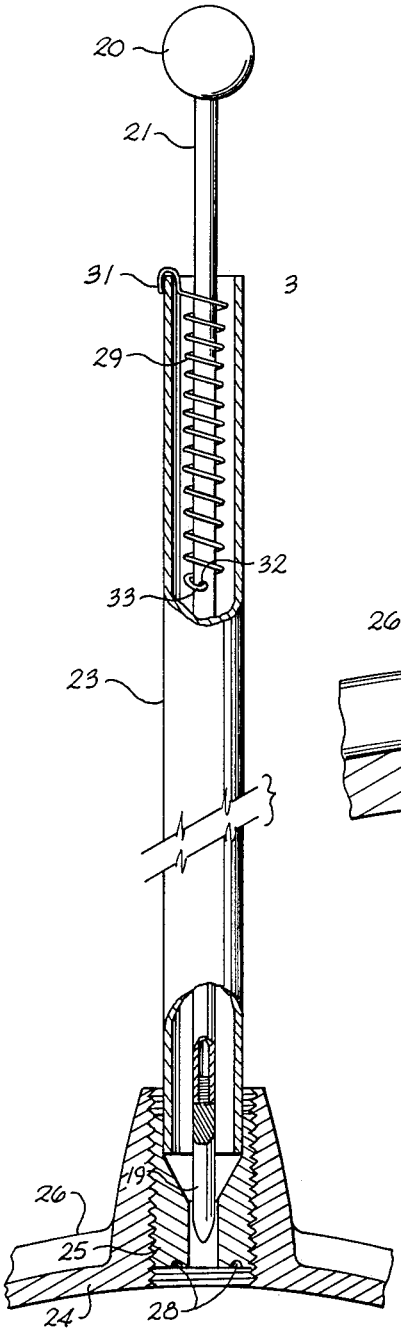
FIG. 5 shows a detailed sectional view of the spring as attached to the shaft and tube and a sectional view of the spike-and-tube interface, the tension modulator and a portion of the cup.
Figure 6:
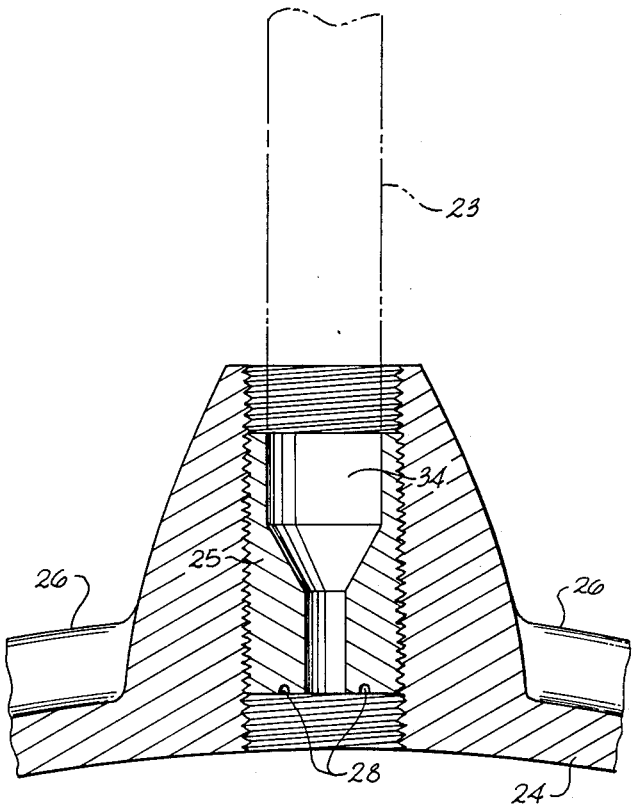
FIG. 6 shows a more detailed view of the tension modulator in the cup.

Within the shaft 23 is the spring 29 best seen in FIG. 5. The spring 29 has a first tang 31 which clips to the top 30 of the shaft 23 and a second tang 33 which is inserted into a hole 32 in tube 21. As the tube is moved downwardly by pressure on the handle 20, the spring 29 is stretched. Preferably spring 29 has a tension of approximately 0.8 pounds per linear inch.

The bottom of the tube 21 is internally threaded to receive the solid spike 19. It is important to be able to detach and replace the spike 19 since it is repeatedly driven into dirt that may contain roots or rocks. Repeated use of the spike will tend to cause wear, perhaps damaging or bending the spike. Also, the improved golf bag is slightly longer than the standard, unimproved golf bag and would not fit into a standard golf bag shipping carton unless the spike is detachable.

The unstretched spring 29 holds the tube 21 and spike 19 in the at-rest position. In the at-rest position, the spike 19 is completely withdrawn into the shaft 23 and does not show from the bottom of the golf bag 10. When tube 21 is in the at rest position, top handle 20 is just below the head of the tallest of clubs 11.

When the golfer pushes down on the handle 20, he causes the tube 21 sliding through the hole in the club separator 22 and the spike 19 to slide through the hole 34 in the tension modulator 25 and stretches the spring 29 as the spike 19 drives into the ground. The tube 21 and the spike 19 are thus placed in the actuated position.

In use a golfer gets a feeling for the depth to which the spike 19 must be driven, given the soil type and condition and the wind. A spike depth of approximately six inches is sufficient for soft ground and most weather conditions encountered.

By advancing or retreating the tension modulator 25 in its threads, the shaft 23 moves up or down and thus increasing or decreasing, respectively, the distance between the top collar 12 and the bottom collar 13. At the bottom of the tension modulator 25 are indentations 28 for advancing the modulator 25. These indentations 28 preferably mate with the jaws of a golf shoe spike wrench (not shown) carried as part of the paraphernalia in compartment 17.

The adjustment of the tension in the sides 16 of the golf bag 10 may be required if the flexible material stretches in hot weather or shrinks in cold. Also, if the golf bag is stored in a small space, the tension modulator 25, shaft 23, tube 21, spike 19 and spring 29 can be removed to allow the collapse of the bag to the desired length. When the bag 10 is initially returned to the proper geometry, several adjustments may be necessary as the bag material gradually relaxes under tension. This adjustment capability is very important to the continued, reliable functioning of the spiking and retracting mechanism since it assures the firm alignment of its parts.

It is clear from the above description of the preferred embodiment that changes can be made in the materials and contruction and the arrangement of the elements without departing from the spirit and scope of the invention as defined in the following claims.

I claim:

1. A golf bag having a top collar, a bottom collar spaced apart from said top collar, a flexible material attached to said top collar and to said bottom collar defining the sides of said golf bag wherein the improvement comprises:

a club separator attached to said top collar having a top, a bottom opposite said top of said club separator and a first hole extending through said club separator;

a circular flange attached to said bottom collar, said circular flange having a second hole having interior threads;

a tension modulator having exterior threads engaging the interior threads of said second hole of said circular flange so that said tension modulator is adjustable axially thereby allowing changes in the distance between said top collar and said bottom collar so that tension in said flexible material can be maintained if said flexible material stretches or shrinks, said tension modulator having a third hole;

a hollow shaft having a top and a bottom, said hollow shaft top abutting the bottom of said club separator, said hollow shaft being centered on said first hole, said hollow shaft bottom received by said tension modulator and centered on said third hole in said tension modulator, said third hole of said tension modulator dimensioned to receive said hollow shaft;

a tube having a top handle and a bottom slidably positioned within said hollow shaft and aligned with said first and said third holes, a spike threaded to the bottom of said tube, said tube having an at-rest position in which said tube slides in said first hole to extend said handle at a first distance above said top of said club separator, and said tube having an actuated position in which said spike slides through said third hole in said tension modulator to extend said spike a second distance below said bottom collar; and a coil spring having a first tang clipped to said shaft top and a second tang attached to said tube so that said coil spring is extended when said tube is slid to said actuated position and said spring is not extended when said tube is in said at-rest position.

2. The improvement of claim 1 wherein said coil spring has sufficient tension when extended to retract said tube from the actuated position to the at-rest position when said golf bag is lifted but not enough tension to retract said tube from said actuated position to said at-rest position when said spiked bottom is in the ground.

3. The improvement of claim 2 wherein the spring tension is approximately 0.8 pounds per linear inch.

4. The improvement of claim 1 wherein said flange has a plurality of radial arms for stiffening.

5. The improvement of claim 4 wherein said tension modulator includes indentation means for receiving a golf shoe cleat wrench for adjusting said tension modulator.

6. The improvement of claim 1 wherein said first distance is sufficient to allow said top handle to be just below the head of the tallest club in said golf bag when said tube is in said at rest position and said second distance is sufficient to hold said golf bag in an upright position on the ground when said tube is in said actuated position.

* * * * *